US006122889A

United States Patent [19]

Zeidler

[11] Patent Number: 6,122,889

[45] Date of Patent: Sep. 26, 2000

[54] WEATHER RESILIENT, SEAMLESS, THERMOPLASTIC ROOF COVERING MATERIAL AND METHOD OF PRODUCTION

[76] Inventor: Bernard Zeidler, 150-15-72 Rd., St A, Flushing, N.Y. 11367

[21] Appl. No.: 09/299,099

[22] Filed: Apr. 26, 1999

Related U.S. Application Data

[63] Continuation-in-part of application No. 08/788,255, Jan. 24, 1997, Pat. No. 5,937,603, which is a continuation-in-part of application No. 08/520,244, Aug. 28, 1995, Pat. No. 5,733,408, which is a division of application No. 08/519,744, Aug. 28, 1995, Pat. No. 5,630,895, which is a continuation-in-part of application No. 07/926,196, Aug. 7, 1992, abandoned.

[51] Int. Cl.[7] ..... E04G 21/00

[52] U.S. Cl. ..... 52/746.11; 52/741.4; 52/748.11; 52/708

[58] Field of Search ..... 52/408, 409, 741.4, 52/746.11, 745.13, 748.11, DIG. 16

[56] References Cited

U.S. PATENT DOCUMENTS

| | | | |
|---|---|---|---|
| 4,671,036 | 6/1987 | Sullivan | 52/746.11 X |
| 5,142,837 | 9/1992 | Simpson et al. | 52/409 |
| 5,150,510 | 9/1992 | Moreland | 52/741.4 |
| 5,165,210 | 11/1992 | Partyka et al. | 52/408 X |
| 5,228,264 | 7/1993 | Whitman | 52/746.11 |
| 5,644,882 | 7/1997 | Brown, Jr. | 52/409 X |

*Primary Examiner*—Christopher T. Kent
*Assistant Examiner*—Brian E. Glessner
*Attorney, Agent, or Firm*—Judith Adele Plotkin

[57] ABSTRACT

The present invention describes a lightweight, flexible, weather resilient, seamless, waterproof, and thermoplastic roof covering layer and a method to prepare such a layer. The method is similar to that used in the preparation of clothing wherein a pattern, which may be out of paper, is prepared according to the measurements of the roof and any protruding or embedded structures thereon. Thermoplastic fabric is cut according to the pattern specifics. The fabric pieces are attached to each other to form a snugly fitting roof covering layer which is then fused and compressed in situ.

20 Claims, 1 Drawing Sheet

WEATHER RESILIENT, SEAMLESS, THERMOPLASTIC ROOF COVERING MATERIAL AND METHOD OF PRODUCTION

This application is a continuation-in-part of U.S. application Ser. No. 08/788,255 filed on Jan. 24, 1997 now U.S. Pat. No. 5,937,603, which is a continuation-in-part of U.S. application Ser. No. 08/520,244 now U.S. Pat. No. 5,733,408 filed on Aug. 28, 1995, which is a division of U.S. application Ser. No. 08/519,744 now U.S. Pat. No. 5,630,895 filed on Aug. 28, 1995, which is a continuation-in-part of U.S. application Ser. No. 07/926,196 filed on Aug. 7, 1992, abandoned.

BACKGROUND

The novel invention described herein relates to an improved, easily constructed, roof covering material, which is more resistant to leaks and water seepage, which is better able to withstand adverse weather conditions, and which requires less maintenance than roof coverings presently in use, and to a method of production of said roof covering material.

U.S. Pat. Nos. 5,365,703, 5,630,895, and 5,733,408 issued the inventor of the present invention have all stemmed from the same parent application Ser. No. 07/926,196 and are all included herewith by reference in their entirety. Similarly, U.S. application Ser. No. 08/788,255, now pending publication, stemmed from the same parent and is included herein by reference in its entirety.

U.S. Pat. No. 5,630,895 describes a method of preparing seamless, durable, resilient, waterproof, weather resistant, thermoplastic covering layers formed in situ with a novel high temperature pressure roller. The improvement of the present invention over this method lies in the use of fiber fabric rather than loose fibers from which to form the covering layer(s). The fiber fabric, is at least partially prefabricated in one piece to the specific measurements of the roof, as described in patent pending application '255.

A further improvement is that the fiber fabric is in the shape of the roof when laid down and covering all structures protruding from or embedded in said roof. After compressing, fusing and heat treating as described in '895, the covering layer is seamless, durable, resilient, waterproof, weather resistant, and without need for the use of tar holders when used with a temperature control system such as those described in '703 and in patent pending application '255.

DETAILED DESCRIPTION OF THE PREFERRED EMBODIMENTS

Figure 1:
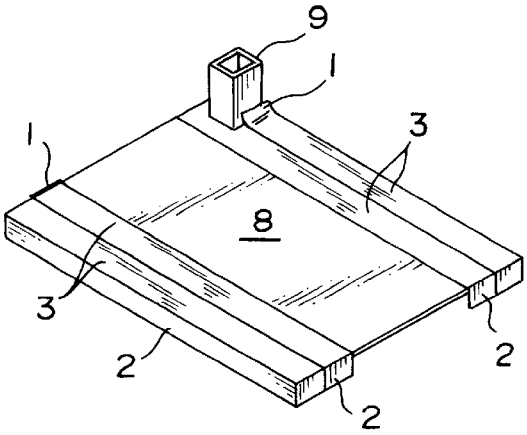
FIG. 1 depicts the making of a measured roof pattern from paper or some similar material.
Figure 4:
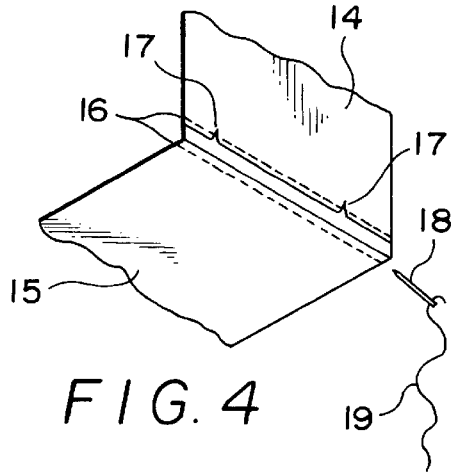
FIG. 4 shows a method of connecting the fabric pieces into a single piece roof covering unit.

The present invention forms the desired thermoplastic roof covering on the roof similar to the way a snugly fitted piece of clothing is made. First the roof measurements are taken. All measurements of the roof and all the structures on the roof are used. As seen in FIG. 1, a pattern of paper pieces [3] or some other readily useable material is then formed either directly on the roof [8] or through use of the measurements elsewhere. Seam allowances [1] and overlaps [2] are included so that pieces may be attached to each other at the exact roof measurement at the corresponding measured site. These allowances and overlaps are marked [17] in some way adequate to indicate how and where the pieces are to be attached to each other as seen in FIG. 4. FIG. 1 shows paper pieces [3] being used to make the roof pattern. These pieces may alternatively be glued together on the roof to make a single piece pattern.

The pattern will also include extra material which will overlap [2] the roof edges so that the ends of the roof covering material will be sealed onto the vertical outside walls of the building down to a level below the actual roofing layers. If there is a parapet along the edge of the roof, the overlap will be sealed up and over the parapet to cover the parapet up to at least about a couple inches of the outside wall of the parapet. Other solid structures protruding from the roof are similarly covered by the pattern and then, later, by the roof covering material derived from the pattern.

Figure 2:
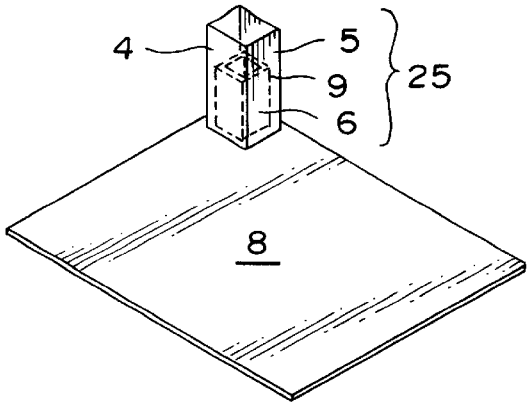
FIG. 2 depicts the making of 'sleeves' to cover structures protruding from the roof.

In FIG. 2, pieces are made for open ended structures, such as pipes protruding from the roof, which can be attached to the other pieces as a sleeve [25] would be attached to a blouse. The sleeve piece [25] will have enough overlapping seam material [4] which can be attached to itself to form a cylindrical or other appropriately shaped, snugly fitting covering for the structure to be covered as shown in FIG. 2. Additional material will be included in the pattern piece in the vertical direction [5] so that the cuff end of the piece can be folded down into the open structure [9] in order to cover all the inside wall space as per the measurements taken while leaving open any functional openings within the structure [6]. Standard pipe opening covers [7] can be used after the roof covering material corresponding to the pattern pieces is sealed on [23] and in [26] the pipe (or other similar structure) as depicted in FIG. 5.

Figure 3:
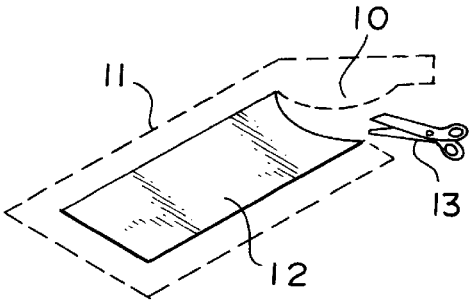
FIG. 3 shows the preparation of the fiber fabric according to the pattern pieces.

After the pattern pieces [12] are all prepared, fabric [11] of thermoplastic fibers is cut [13] to the pattern pieces' measurements as seen in FIG. 3. Excess fabric [10] is cut away. The fabric pieces [14,15] are then connected along the seams [16] by sewing with a needle [18] and thread [19] or some other method which will attach the pieces to each other according to the markings [17] used to indicate where and how the pieces are to be put together as seen in FIG. 4. The cutting of the fabric and attaching of the pieces to each other can be done anywhere. If partial melting, fusing and/or compressing together of the fabric pieces, especially along the seams, is desired, the process can be done in a factory setting. Any melting of the fabric fibers would be done on a non-reactive release sheet material so that the fabric pieces will adhere only to each other. The melting can be complete or partial or can be done with the method described in the '895 patent. After the fabric pieces are attached to each other according to the roof measurements and then, optionally, partially or fully melted, the flexible and lightweight entire roof covering single layer [21] can be rolled or folded up and transported to the roof where it is laid out upon the roof as shown in FIG. 5. Lastly, the thusly prepared roof covering layer is heat fused and compressed [24] as described in the '895 patent reference included herein by reference and as shown in FIG. 6 via use of a covered hot oil heated roller [24]. The compressing and fusing treatment is described in '895 as done in the absence of ambient air through the use of an air-impermeable covering layer [27] during the fusing and compressing treatment.

Figure 5:
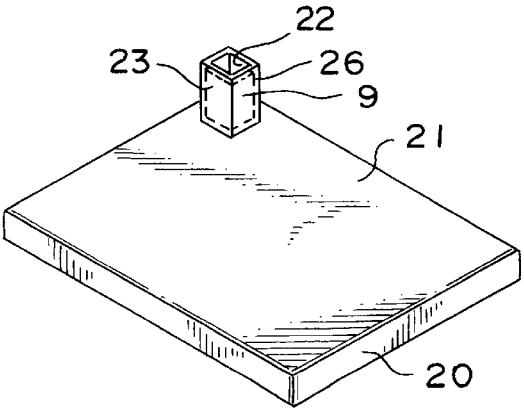
FIG. 5 shows the lay down of the single piece roof covering unit onto the corresponding roof.
Figure 6:
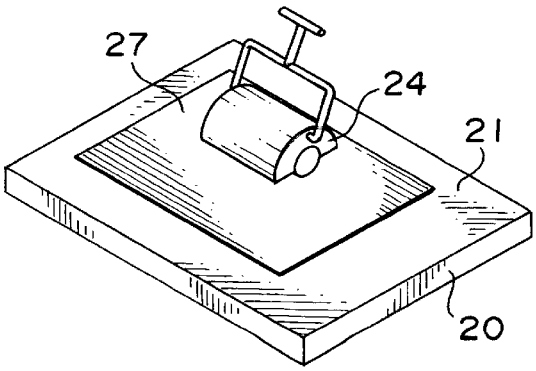
FIG. 6 shows the final heat and compression treatment of the fiber fabric into a roof covering layer.

The resultant roof covering layer has no seams and overlaps [20, FIGS. 5 & 6] the ends of the roof and all protruding structures [6, 26; FIGS. 2 & 5] in such a way that there will be no need for tar holders or similar roof protective measures. It is weather resilient, waterproof, seamless, and leak free. Severe stresses from expansion and contraction of the roof and roofing materials can be prevented by use of a temperature control system, e.g., the systems described in '895 and '703 patents or the '255 patent application.

The embodiments described above and in the claims which follow are illustrative of the novel features of this invention. Although the preferred embodiments of the present invention have been fully described with reference to the accompanying drawings, various changes and modifications are apparent to those skilled in the art. Such changes and modifications are to be understood as within the scope of the present invention as defined by the appended claims, unless they depart therefrom.

What is claimed is:

1. A method to produce a seamless, weather resilient, waterproof, thermoplastic roof covering on a roof which optionally has solid or open ended protruding or embedded structures attached thereto comprising the steps of a. Measuring said roof and said structures on said roof in all directions possible to get measurements of said roof and said structures;

b. Making a pattern of said roof out of a readily useable material according to said measurements wherein said pattern comprises at least one piece of said useable material;

c. Providing overlap and seam allowances for each of said at least one piece of said useable material;

d. Marking each of said at least one piece in a first manner which will allow accurate attachment of each of said at least one piece to each other in order to form a roof covering material which exactly covers said roof according to said measurements;

e. Cutting thermoplastic fabric pieces according to said at least one piece of said pattern;

f. Marking each of said fabric pieces in a second manner which allows accurate attachment of said fabric pieces to each other and in accordance with said first manner;

g. Attaching said fabric pieces to each other according to said second manner of marking to make a flexible and lightweight entire roof covering single layer;

h. Placing said single layer on said roof in a way which snugly covers said roof and said structures; and i. Fusing and compressing said single layer in the absence of ambient air.

2. A method according to claim 1 wherein said readily useable material is paper.

3. A method according to claim 1 wherein said fabric pieces comprise thermoplastic fibers.

4. A method according to claim 1 wherein said fabric pieces comprise randomly laid fibers.

5. A method according to claim 1 wherein said fabric pieces comprise woven fibers.

6. A method according to claim 1 wherein said fabric pieces comprise knitted fibers.

7. A method to produce a seamless, weather resilient, waterproof, thermoplastic roof covering on a roof, which optionally has solid or open ended protruding or embedded structures attached thereto, comprising the steps of a. Measuring said roof and said structures on said roof in all directions possible to get measurements of said roof and said structures;

b. Cutting fabric pieces according to said measurements with the provision of overlap and seam allowances for each of said fabric pieces;

c. Marking each of said fabric pieces in a manner which allows accurate attachment of said fabric pieces to each other in order to form a roof covering material which exactly covers said roof according to said measurements;

d. Attaching said fabric pieces to each other according to said manner of marking to make a flexible and lightweight entire roof covering single layer;

e. Placing said single layer on said roof in a way which snugly covers said roof and said structures; and f. Fusing and compressing said single layer in the absence of ambient air.

8. A roof covering prepared by the method of claim 7.

9. A method according to claim 7 wherein said single layer is melted partially prior to being placed on said roof.

10. A method according to claim 7 wherein said single layer is melted fully prior to being placed on said roof.

11. A method according to claim 7 wherein said single layer is partially fused and compressed in the absence of ambient air prior to being placed on said roof.

12. A method according to claim 7 wherein said single layer is completely fused and compressed in the absence of ambient air prior to being placed on said roof.

13. A method according to claim 1 wherein said attaching of said fabric pieces is by sewing.

14. A method according to claim 7 wherein said attaching of said fabric pieces is by sewing.

15. A method according to claim 1 wherein said single layer is placed on a non-reactive release layer prior to said optional fusing and compressing.

16. A method according to claim 1 wherein said single layer is placed on a non-reactive release layer prior to said optional melting.

17. A method according to claim 15 wherein said single layer is covered by an air impermeable layer during said optional fusing and compressing.

18. A method according to claim 1 wherein said single layer on said roof is covered by an air-impermeable layer during said fusing and compressing.

19. A method according to claim 7 wherein said single layer on said roof is covered by an air-impermeable layer during said fusing and compressing.

20. A method according to claim 7 in which said roof has at least one open ended structure with inside and outside walls and in which at least one of said fabric pieces is a sleeve piece with an overlap section which is tucked into said at least one open ended structure to fully cover said inside and outside walls.

* * * * *